US010309748B2

(12) United States Patent
Samson et al.

(10) Patent No.: US 10,309,748 B2
(45) Date of Patent: Jun. 4, 2019

(54) FIREARM RAIL/HANDGUARD AND MOUNTING SYSTEM

(71) Applicant: Samson Manufacturing Corp., Keene, NH (US)

(72) Inventors: Scott Samson, Spofford, NH (US); Tanner Landis, Keene, NH (US); Andrew Dreher, Spofford, NH (US)

(73) Assignee: Samson Manufacturing Corporation, Keene, NH (US)

( * ) Notice: Subject to any disclaimer, the term of this patent is extended or adjusted under 35 U.S.C. 154(b) by 0 days.

(21) Appl. No.: 15/873,382

(22) Filed: Jan. 17, 2018

(65) Prior Publication Data

US 2018/0202758 A1 Jul. 19, 2018

Related U.S. Application Data

(60) Provisional application No. 62/447,188, filed on Jan. 17, 2017.

(51) Int. Cl.

| | |
|---|---|
| ***F41C 23/00*** | (2006.01) |
| ***F41C 23/16*** | (2006.01) |
| ***F41A 21/48*** | (2006.01) |
| ***F41A 3/66*** | (2006.01) |

(52) U.S. Cl.
CPC ..... *F41C 23/16* (2013.01); *F41A 3/66* (2013.01); *F41A 21/48* (2013.01)

(58) Field of Classification Search
CPC ..... F41C 23/16
See application file for complete search history.

(56) References Cited

U.S. PATENT DOCUMENTS

| | | | | |
|---|---|---|---|---|
| 7,770,317 | B1 * | 8/2010 | Tankersley | F41C 23/16 42/71.01 |
| 8,904,691 | B1 | 12/2014 | Kincel | |
| 9,335,117 | B2 | 5/2016 | Miller | |
| 9,389,043 | B1 * | 7/2016 | Zhang | F41C 23/16 |
| 9,464,865 | B2 * | 10/2016 | Shea | F41C 23/16 |
| 9,791,239 | B1 * | 10/2017 | Kincel | F41C 23/16 |
| 2011/0000119 | A1 * | 1/2011 | Desomma | F41A 3/66 42/75.02 |
| 2011/0126443 | A1 * | 6/2011 | Sirois | F41C 23/16 42/90 |
| 2011/0239513 | A1 * | 10/2011 | Sandman | F41C 23/16 42/90 |
| 2012/0186123 | A1 * | 7/2012 | Troy | F41C 23/16 42/71.01 |
| 2012/0246989 | A1 * | 10/2012 | Troy | F41C 23/16 42/71.01 |
| 2017/0097207 | A1 * | 4/2017 | Hines | F41C 23/16 |
| 2017/0160048 | A1 * | 6/2017 | Galletta, II | F41C 23/16 |
| 2018/0306551 | A1 * | 10/2018 | Reid | F41C 23/16 |

* cited by examiner

*Primary Examiner* — Gabriel J. Klein
(74) *Attorney, Agent, or Firm* — Burns & Levinson LLP; Bruce D. Jobse

(57) ABSTRACT

An assembly for mounting a handguard to a firearm utilizes a biasing element disposed intermediate the barrel nut and the interior end of the handguard and a clamping element also disposed intermediate the barrel nut and the interior end of the handguard but positioned opposite the biasing element about the perimeter of the barrel nut. One or both of the biasing element and clamping element have multiple surfaces which mimic portions of the exterior profile of the barrel nut to prevent any of longitudinal, axial, or radial misalignment of the handguard relative to the axis of the firearm barrel.

16 Claims, 6 Drawing Sheets

FIREARM RAIL/HANDGUARD AND MOUNTING SYSTEM

FIELD OF THE INVENTION

The disclosure relates to the field of firearm accessories, and, more specifically, to an assembly for mounting a modular rail assembly to a firearm which maintains proper alignment of the assembly with the firearm barrel.

BACKGROUND OF THE INVENTION

In the general field of combat and commercial weaponry, there is a broad range of accessories available for mounting onto standard firearms in order to upgrade the capability of these weapons. Of particular interest in the context of upgrade accessories is the M16/M4 weapon system that is typically utilized in military or combat settings. Most new models of the M16/M4 weapons also include a dovetail rail interface integrally formed along the top of the upper receiver. This interface rail provides a convenient mounting point for many of the available accessories for use with the M16/M4 firearm, such as scopes, sighting devices, lasers, and directed fire devices. The barrel is held in assembled relation with the upper receiver by a barrel nut that is threaded onto the outside surface of the barrel-receiving receptacle.

Some commercially available after market rail/handguard assembly systems require permanent modification of the firearm, such as replacing the original barrel nut with a proprietary barrel nut design, before installation thereof, while others are compatible with the existing configuration of the barrel nut provided by the manufacturer. Either way, it is critical during the installation and use of the firearm rail/handguard assembly that the alignment of the rail/handguard assembly longitudinally, axially, and radially relative to the axis of the barrel bore be free from slippage, canting, or other angular displacements, lest accessories such as scopes securable to the firearm rail/handguard assembly not provide true aiming of the firearm.

It would therefore be useful to provide a modular rail/handguard assembly for use with a firearm that prevents any of longitudinal, axial, or radial misalignment of the modular rail assembly relative to the barrel of the firearm at the time of installation.

It would be further useful to provide a modular rail/handguard assembly for use with a firearm which prevents any of longitudinal, axial, or radial misalignment of the modular rail assembly relative to the barrel axis of the firearm during use.

BRIEF SUMMARY OF THE INVENTION

Disclosed is an assembly for mounting a modular rail/handguard to a firearm which maintains proper alignment of the modular rail assembly with the firearm barrel. In particular, the disclosure is directed to an improved mounting configuration for attaching the modular rail/handguard assembly to the barrel nut of a firearm in a manner that prevents any of longitudinal, axial, or radial misalignment of the modular rail handguard assembly relative to the barrel of the firearm. The assembly utilizes a biasing element disposed intermediate the barrel nut and the interior end of the handguard and a clamping element also disposed intermediate the barrel nut and the interior end of the handguard but positioned opposite the biasing element about the perimeter of the barrel nut. One or both of the biasing element and clamping element have multiple surfaces which mimic portions of the exterior profile of the barrel nut to prevent any of longitudinal, axial, or radial misalignment of the handguard relative to the axis of the firearm barrel.

According to one aspect of the disclosure, an assembly apparatus for securing a handguard to a firearm having a barrel nut, the assembly apparatus comprises: a handguard having a first end with an interior diameter shaped to receive at least a portion of an exterior of the barrel nut; a biasing element disposable intermediate the barrel nut and the interior diameter of the handguard, the biasing element having first and second biasing surfaces disposable adjacent first and second exterior surface portions, respectively, of the barrel nut; a first mechanism for securing the biasing element intermediate the handguard and the barrel nut, a clamping element having first and second surfaces disposed adjacent first and second exterior surface portions, respectively, of the barrel nut; and a second mechanism for securing the clamping element intermediate the handguard and the barrel nut.

In one embodiment, the biasing element prevents movement of the handguard longitudinally along the axis of the barrel. In another embodiment, one or both of the biasing element and clamping element have arcuate surfaces disposed adjacent the exterior perimeter of the barrel nut and prevent radial and/or rotational movement of the barrel nut within the interior of the handguard end.

According to another aspect of the disclosure, an assembly kit for use with a firearm having a barrel nut and a handguard, the kit comprising: a biasing element disposable intermediate the barrel nut and an interior diameter of the handguard; a first mechanism for securing the biasing element intermediate the handguard and the barrel nut, a clamping element having first and second surfaces disposed adjacent first and second exterior surface portions, respectively, of the barrel nut; and a second mechanism for securing the clamping element intermediate the handguard and the barrel nut.

According to yet another aspect of the disclosure, an assembly apparatus for securing a handguard to a firearm, the firearm having a barrel nut with an exterior perimeter, the assembly apparatus comprises: a handguard having a first end with an interior diameter shaped to receive at least a portion of the exterior portion of the barrel nut; and a first clamping element disposable intermediate the interior diameter of the handguard and a first location on the exterior perimeter of the barrel nut, the first clamping element having an arcuate surface with a first radius of diameter and disposable adjacent the first location on the exterior perimeter of the barrel nut, a second clamping element disposable intermediate the interior diameter of the handguard and a second location on the exterior perimeter of the barrel nut opposite the first location, the second clamping element having an arcuate surface with the first radius of diameter and disposable adjacent the second location on the exterior perimeter of the barrel nut, wherein one of the first and second clamping elements has a second arcuate surface having the second radius of diameter and disposable adjacent the exterior perimeter of the barrel nut.

According to yet another aspect of the disclosure, a method for mounting a handguard to a firearm having a cylindrical barrel nut, the method comprises: A) disposing a first end of the handguard about a portion of the barrel nut; B) inserting a biasing element intermediate the first end of the handguard and the barrel nut at a first location about an exterior perimeter of the barrel nut; C) inserting a clamping element intermediate the first end of the handguard and the barrel nut at a second location opposite the first location about the exterior perimeter of the barrel nut, the clamping element having first and second surfaces disposed adjacent first and second exterior surface portions, respectively, of the barrel nut; and D) urging the clamping element against the barrel nut.

For a better understanding of the invention, its operating advantages, and the specific objects attained by its uses, reference should be had to the accompanying drawings and descriptive matter in which there is illustrated a preferred embodiment of the invention.

DETAILED DESCRIPTION OF THE INVENTION

Figure 1:
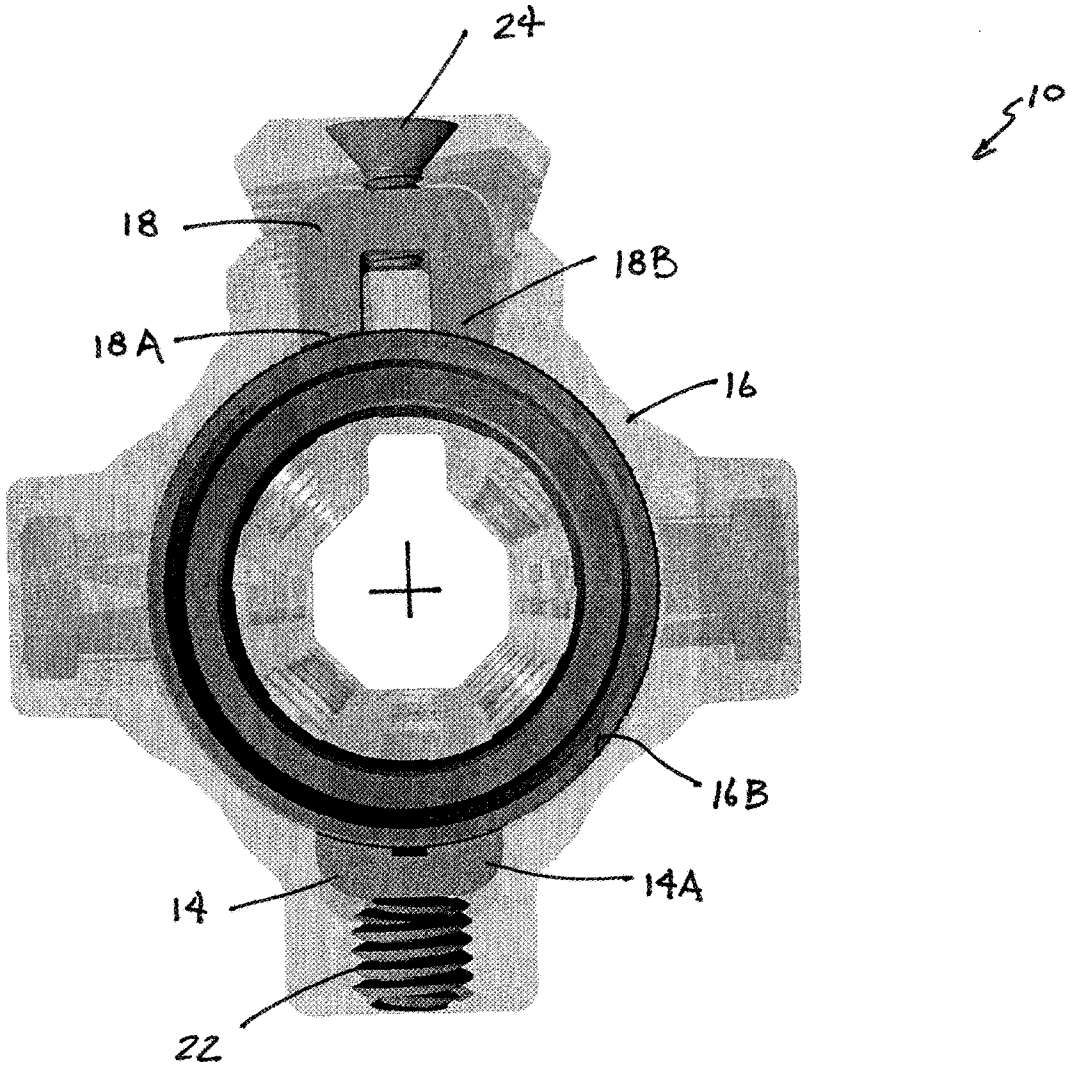
FIG. 1 is a front, end-on view of an embodiment of the mounting assembly in accordance with the disclosure.
Figure 2:
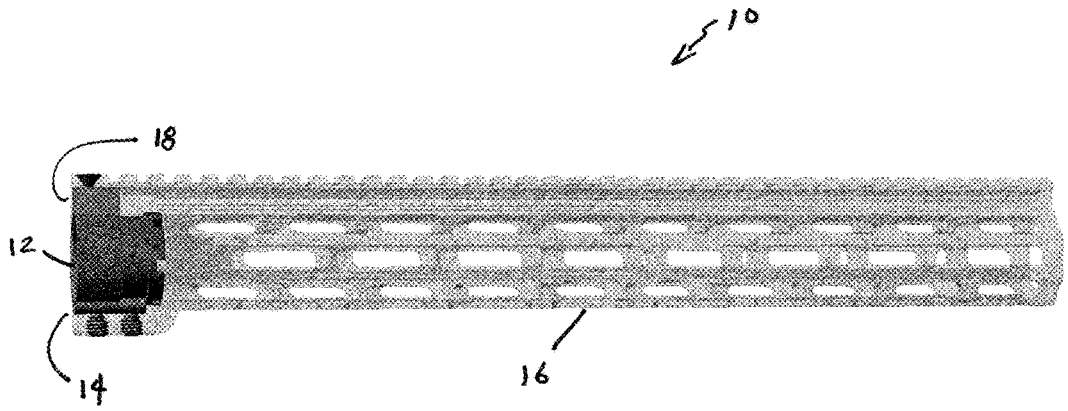
FIG. 2 is a side, plan view of an embodiment of the mounting assembly system in accordance with the disclosure.
Figure 3:
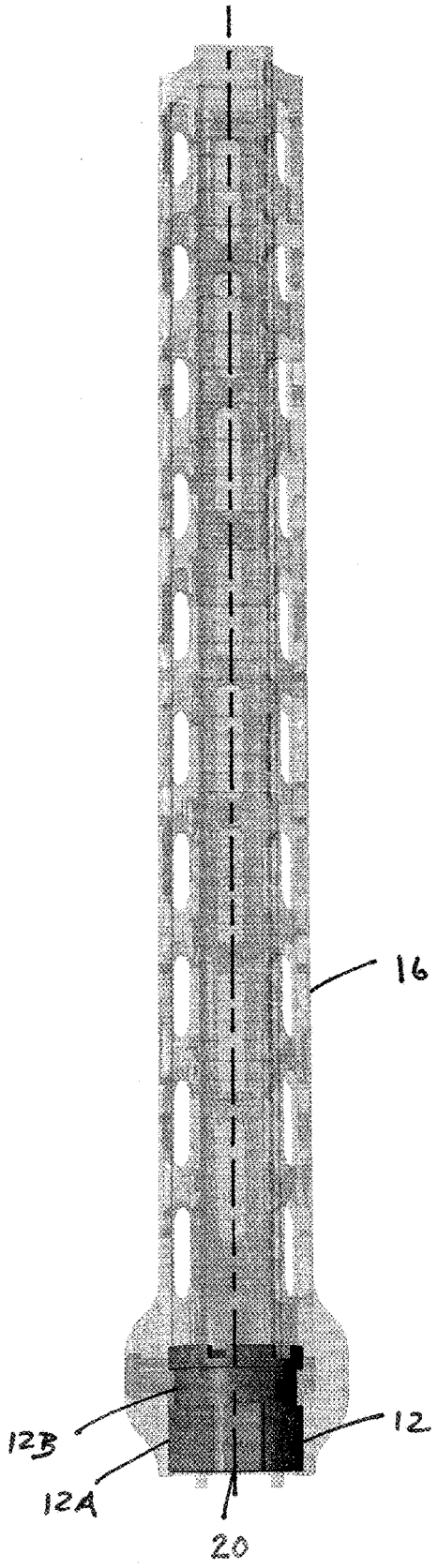
FIG. 3 is a top plan view of an embodiment of the mounting assembly system in accordance with the disclosure.
Figure 4:
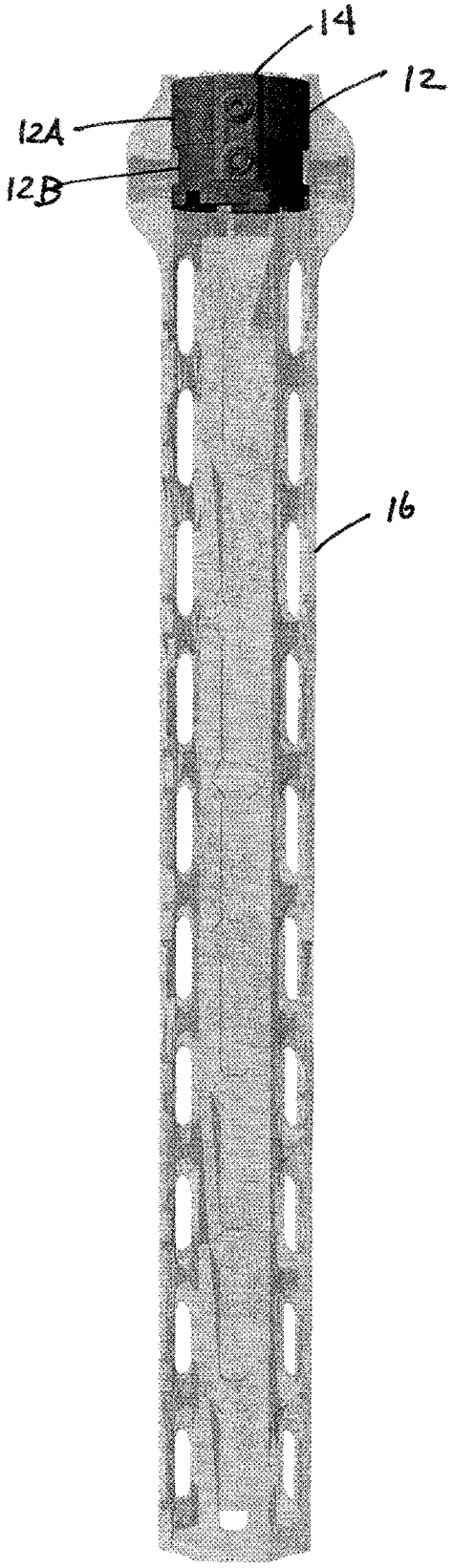
FIG. 4 is a bottom, plan view of an embodiment of the mounting assembly system in accordance with the disclosure.
Figure 5:
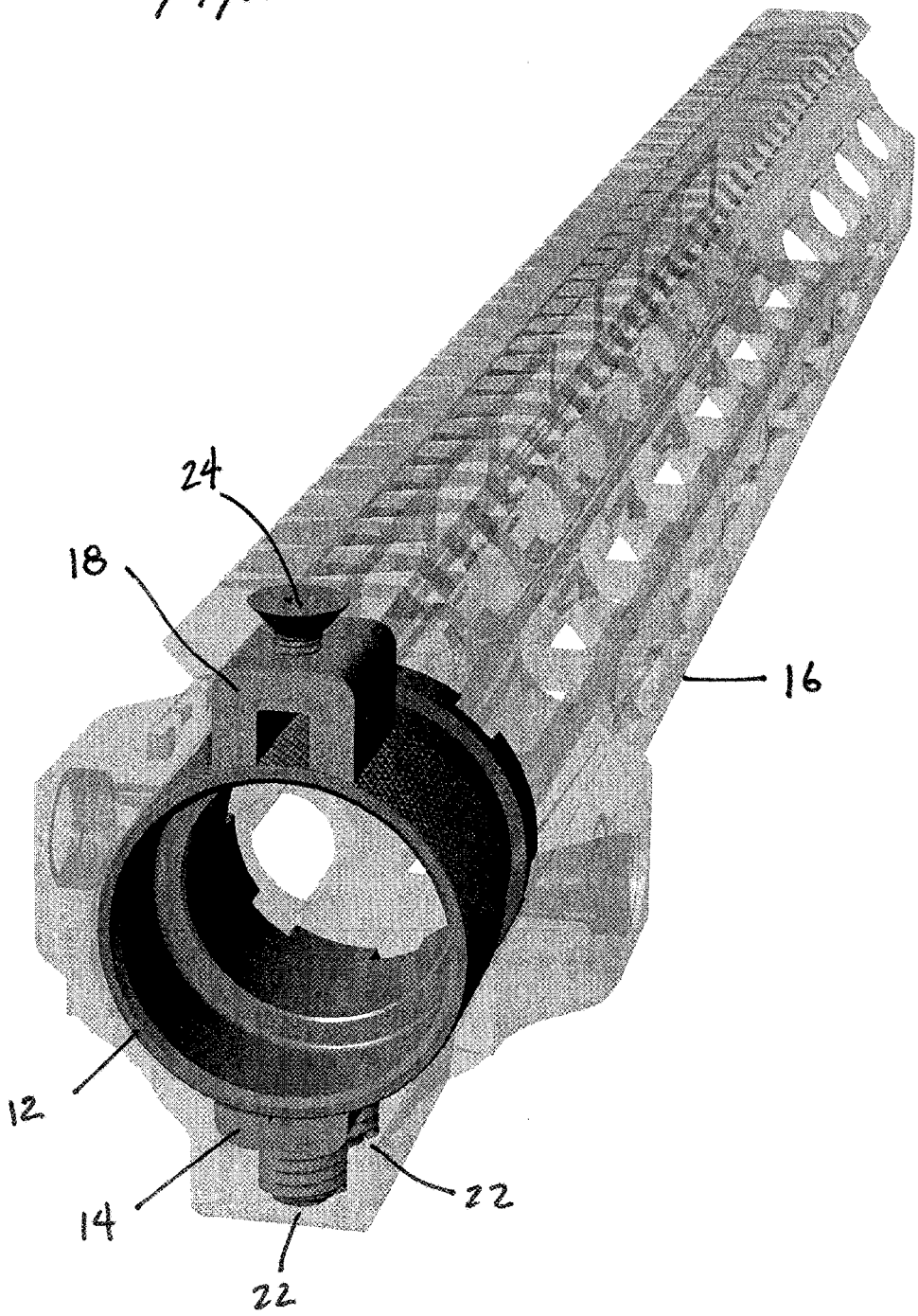
FIG. 5 is a top, perspective view of the embodiment of FIGS. 1-4 in accordance with the disclosure.
Figure 6:
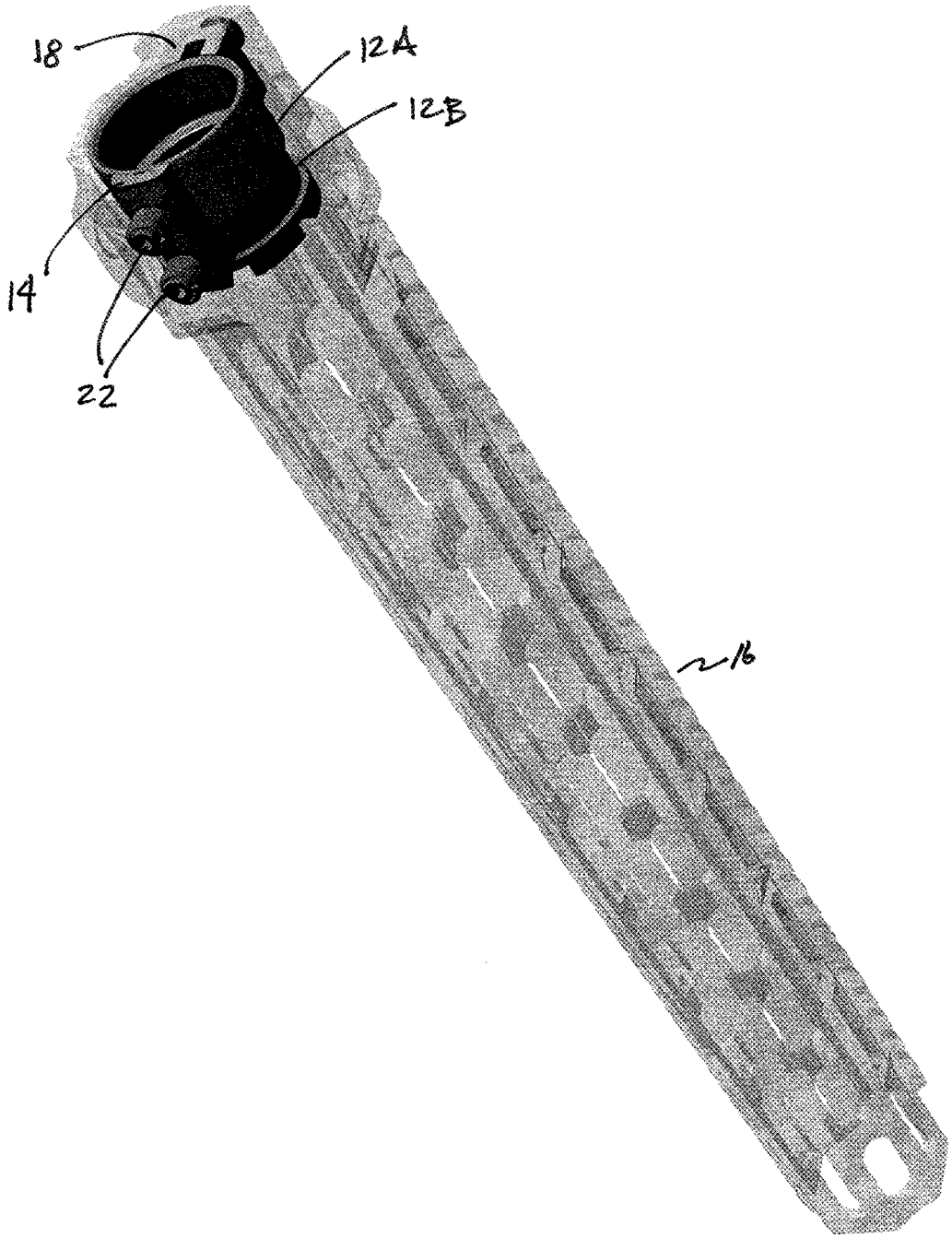
FIG. 6 is a bottom, perspective view of the embodiment of FIGS. 1-4 in accordance with the disclosure.

FIGS. 1-6 illustrate embodiments of the modular assembly 10 for mounting to a rail/handguard in accordance with the disclosure. The mounting assembly 10 comprises a handguard 16, optional barrel nut 12 and mounting system 15. Handguard 16 is the structural element that supports the entire assembly and serves to transfer the loads or additional weight induced by any attachments onto the upper receiver of the firearm. Mounting system 15 comprises a clamping element 14 and biasing element 18, as well as their respective attachment mechanisms, which are mechanically coupled intermediate barrel nut 12 and handguard 16, as described herein in greater detail.

As illustrated in the Figures, a cylindrical barrel nut 12 extends longitudinally along an axis 20 and has an exterior perimeter defining first and second exterior surface portions 12A and 12B with different exterior diameter values relative to the axis. In the illustrative embodiment, the transition between the diameters of portions 12A and 12B is abrupt, causing a step down in the diameter of the barrel nut exterior perimeter. In embodiments, barrel nut 12 may have other exterior perimeter surface features as may be designed by the manufacturer of the handguard. Handguard 16 has a first end 16A with an interior diameter 16B shaped to receive at least a portion of one of the first and second exterior barrel nut portions 12A and 12B thereagainst.

Biasing element 18 is disposed intermediate the barrel nut 12 and the interior diameter 16B of the handguard 16 and has first and second biasing surfaces 18A and 18B disposed adjacent the first and second exterior surface portions 12A and 12B, respectively, of the barrel nut 12. Biasing element 18 has, in the illustrative embodiment, a generally U-shaped cross-sectional profile as seen in a plane normal to axis 20. In embodiments, the surfaces of biasing element 18 disposed adjacent the exterior perimeter of barrel nut 12, including one or both of first and second biasing surfaces 18A and 18B, may be arcuate in shape with substantially the same degree of curvature as exterior perimeter portion of barrel nut 12 against which they are disposed. In the illustrative embodiment, biasing element 18 is disposed opposite clamping element 14 about the interior of inner diameter 16B of handguard 16 and is seated in an indentation in the interior surface of inner diameter 16B. Two pairs of axially aligned apertures extending at least partially through both biasing element 18 and handguard 16 may accept a fastener 22 or other fastening mechanisms for securing the biasing element 18 intermediate the handguard 16 and the barrel nut 12, as illustrated in the Figures.

Clamping element 14 is also disposed intermediate the barrel nut 12 and the interior diameter 16B of the handguard 16. In the illustrative embodiment, clamping element 14 may have a generally L-shaped length profile, as seen along an axis parallel to axis 20, and may have a generally solid cross-sectional profile, as seen from a plane normal to axis 20, with first and second clamping surfaces 14A and 14B disposed adjacent the exterior perimeter of barrel nut 12. Clamping surfaces 14A and 14B may be arcuate in shape with substantially the same degree of curvature as exterior perimeter portion of barrel nut 12 against which they are disposed. In the illustrative embodiment, exterior perimeter portion of barrel nut 12 against which clamping surfaces 14A and 14B are disposed may be knurled or contain other surface features to enhance frictional engagement therebetween. Clamping element 14 is disposed opposite biasing element 18 about the interior of inner diameter 16B of handguard 16 (and the exterior perimeter of barrel nut 12) and is seated in an indentation in the interior surface of inner diameter 16B. A pair of axially aligned apertures extending at least partially through clamping element 14 and handguard 16 may accept a screw 24 or other fastening mechanism for securing the clamping element 14 intermediate the handguard 16 and the barrel nut 12, as illustrated in the Figures.

In embodiments, clamping surfaces 14A and 14B of clamping element 14 and biasing surfaces 18A and 18B of biasing element 18 are arcuate with a radius of curvature which substantially mimics the radius of curvature of the exterior surfaces of the perimeter of barrel nut 12. In the illustrative embodiment, barrel nut 12 may have multiple different exterior diameters, as illustrated, accordingly one or both of biasing element 18 and clamping element 14 may have multiple arcuate surfaces with respective radii of curvature which substantially mimic the respective radii of curvature of the exterior surfaces of the perimeter of barrel nut 12 to prevent any of longitudinal, axial, or radial misalignment of the handguard relative to the axis of the firearm barrel.

Because clamping element 14 mimics the abrupt transition between the diameters of barrel nut 12 between surfaces 12A and 12B, the longitudinal profile of clamping element 14 along axis 20 is generally L-shaped and prevents of longitudinal misalignment of the handguard assembly relative to axis 20 of barrel nut 12 at the time of installation and during use. Similarly, because clamping surfaces 14A and 14B of clamping element 14 have arcuate surfaces that mimic the respective curvatures of surfaces 12A and 12B of barrel nut 12 with which contact is made, axial and/or radial misalignment of the handguard 16 relative to barrel nut 12 is prevented at the time of installation and during use.

A method for mounting the handguard 16 to a firearm having a cylindrical barrel nut 12 comprises disposing a first end of the handguard 16 about a portion of the barrel nut; B) inserting a biasing element 18 intermediate the first end of the handguard 16 and the barrel nut 12 at a first location about an exterior perimeter of the barrel nut and then inserting a clamping element 14 intermediate the first end of the handguard and the barrel nut at a second location opposite the first location about the exterior perimeter of the barrel nut. The clamping surfaces 14A and 14B are disposed adjacent first and second exterior surface portions, respectively, of the barrel nut 12. Once biasing element 18 is seated intermediate handguard 16 and barrel nut 12, screw 24 can be used to force biasing element 18 securely against the barrel nut 12. Similarly, once clamping element 14 is seated intermediate handguard 16 and barrel nut 12, fasteners 22 can be used to force clamping element 14 securely against the barrel nut 12.

Handguard 16 may be formed generally as a tubular enclosure that is configured to encircle the barrel of the firearm when assembly 10 is installed on the firearm in a mounted position. In the illustrative embodiments, handguard 16 has a unitary or monolithic construction defined by left and right side walls that extend between ends thereof and generally outwardly and downwardly in an arcuate manner from an integrally formed top dovetail rail to form a substantially cylindrical body. Top dovetail rail extends at least partially longitudinally between the forward end and the rearward end. An optional supplemental dovetail rail interface may be slidably attached to the bottom of handguard 16 utilizing an integrally formed projection having a complementary mating cross-sectional profile.

In the embodiments, any elements of assembly 10 and mounting system 15 may be formed of substantially rigid materials including steel, stainless steel, aluminum, ceramics, or other materials capable of withstanding heat generated by the barrel nut 12 during use of the firearm.

As illustrated in the Figures, side walls of the handguard 16 may have a plurality of wall vents extending therethrough to facilitate cooling of the firearm barrel by allowing heated air from the interior of handguard 16 to escape through the vents. It will be obvious to those reasonably skilled in the art that any configuration or shape of sidewall vents, including an open lattice structure, may partially define one or both of sidewalls. It will be further obvious to those reasonably skilled in the art that handguard 16 may have other cross-sectional profiles, such as a pentagon or octagon or other configuration. In addition, although handguard 16 in the illustrative embodiment forms an integral sleeve-like structure, it is contemplated herein that one or more constituent components thereof may be separately assembled into a sleeve-like structure which is insertable over the open end of the barrel.

In embodiments, fasteners 22 may be implemented with a helicoil inserts and threaded fastening mechanisms. The helicoil inserts may have threaded exteriors for coupling with threaded interiors of apertures which extend through the handguard 16. The helicoil inserts may also have a threaded interior which can couple with the threaded exterior of a fastening mechanisms or screw. In some cases, such helicoil inserts may be formed from a stronger and more rigid material than the handguard 16 (i.e., steel versus aluminum) to prevent the handguard 16 from warping, crushing, or otherwise deforming due to force through the fastening mechanisms. In embodiments, the lower surfaces of the fastening mechanisms and the surfaces on clamping element 14 with which they have contact may be flat to maximize contact area. While the fasteners 22 illustrated with regard to the illustrative embodiments have been shown to be helicoil inserts, other fastening mechanisms may be equivalently substituted, including conventional threaded screws such as screws 24.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. An assembly apparatus for securing a handguard to a firearm having a barrel nut, the assembly apparatus comprises:

a handguard having a first end with an interior diameter shaped to receive at least a portion of an exterior of the barrel nut;

a biasing element disposable intermediate the barrel nut and the interior diameter of the handguard, the biasing element having first and second biasing surfaces disposable adjacent first and second exterior surface portions, respectively, of the barrel nut;

a first mechanism for securing the biasing element intermediate the handguard and the barrel nut, a clamping element having first and second surfaces disposed adjacent first and second exterior surface portions, respectively, of the barrel nut; and a second mechanism for securing the clamping element intermediate the handguard and the barrel nut.

2. The apparatus of claim 1 in combination with a cylindrical barrel nut extending along an axis and having an exterior perimeter defining first and second exterior surface portions with different exterior diameter values relative to the axis.

3. The apparatus of claim 1 wherein the biasing element prevents movement of the handguard longitudinally along the axis of the barrel.

4. The apparatus of claim 1 wherein the biasing element has an arcuate surface disposable adjacent the exterior perimeter of the barrel nut to prevent at least one of radial and rotational movement of the handguard first end relative the barrel nut.

5. The apparatus of claim 1 wherein the clamping element has an arcuate surface disposable adjacent the exterior perimeter of the barrel nut to prevent at least one of radial and rotational movement of the handguard first end relative the barrel nut.

6. An assembly kit for use with a firearm having a barrel nut and a handguard, the kit comprising:

a biasing element disposable intermediate the barrel nut and an interior diameter of the handguard;

a first mechanism for securing the biasing element intermediate the handguard and the barrel nut, a clamping element having first and second surfaces disposed adjacent first and second exterior surface portions, respectively, of the barrel nut; and a second mechanism for securing the clamping element intermediate the handguard and the barrel nut.

7. The assembly kit of claim 6 wherein the biasing element has an arcuate surface for positioning adjacent the exterior perimeter of the barrel nut to prevent at least one of radial and rotational movement of the handguard first end relative the barrel nut.

8. The assembly kit of claim 6 wherein the clamping element has an arcuate surface disposable adjacent the exterior perimeter of the barrel nut to prevent at least one of radial and rotational movement of the handguard first end relative the barrel nut.

9. The assembly kit of claim 6 in combination with a cylindrical barrel nut extending along an axis and having an exterior perimeter defining first and second exterior surface portions with different exterior diameter values relative to the axis.

10. The assembly kit of claim 6 in combination with a handguard having a first end with an interior diameter shaped to receive at least a portion of a barrel nut exterior thereagainst.

11. A method for mounting a handguard to a firearm having a cylindrical barrel nut, the method comprising:

A) disposing a first end of the handguard about a portion of the barrel nut;

B) inserting a biasing element intermediate the first end of the handguard and the barrel nut at a first location about an exterior perimeter of the barrel nut;

C) inserting a clamping element intermediate the first end of the handguard and the barrel nut at a second location opposite the first location about the exterior perimeter of the barrel nut, the clamping element having first and second surfaces disposed adjacent first and second exterior surface portions, respectively, of the barrel nut; and D) urging the clamping element against the barrel nut.

12. The method of claim 11 wherein the step of urging the clamping element against the barrel nut comprises rotating a mechanism for securing to force the clamping element against a surface of the barrel nut.

13. The method of claim 11 further comprising E) exposing the barrel nut of the firearm.

14. An assembly apparatus for securing a handguard to a firearm, the firearm having a barrel nut with an exterior perimeter, the assembly apparatus comprises:

a handguard having a first end with an interior diameter shaped to receive at least a portion of the exterior portion of the barrel nut; and a first clamping element disposable intermediate the interior diameter of the handguard and a first location on the exterior perimeter of the barrel nut, the first clamping element having an arcuate surface with a first radius of diameter and disposable adjacent the first location on the exterior perimeter of the barrel nut, a second clamping element disposable intermediate the interior diameter of the handguard and a second location on the exterior perimeter of the barrel nut opposite the first location, the second clamping element having an arcuate surface with the first radius of diameter and disposable adjacent the second location on the exterior perimeter of the barrel nut, wherein one of the first and second clamping elements has a second arcuate surface having the second radius of diameter and disposable adjacent the exterior perimeter of the barrel nut.

15. The assembly apparatus of claim 14 further comprising:

a first mechanism for securing the first clamping element intermediate the handguard and the barrel nut.

16. The assembly apparatus of claim 15 further comprising:

a second mechanism for securing the second clamping element intermediate the handguard and the barrel nut.

* * * * *